United States Patent [19]

Dassler et al.

[11] Patent Number: 4,644,672

[45] Date of Patent: Feb. 24, 1987

[54] OUTER SOLE FOR AN ATHLETIC SHOE HAVING CLEATS WITH EXCHANGEABLE GRIPPING ELEMENTS

[75] Inventors: Armin A. Dassler; Willi Bauer, both of Herzogenaurach, Fed. Rep. of Germany

[73] Assignee: Puma AG Rudolf Dassler Sport, Herzogenaurach, Fed. Rep. of Germany

[21] Appl. No.: 756,249

[22] Filed: Jul. 18, 1985

[30] Foreign Application Priority Data

Jul. 19, 1984 [DE] Fed. Rep. of Germany ..... 3426600

[51] Int. Cl.[4] ..... A43B 5/00

[52] U.S. Cl. ..... 36/134; 36/62

[58] Field of Search ..... 36/134, 59 R, 59 A, 36/59 B, 59 C, 67 R, 67 A, 67 B, 67 C, 67 D

[56] References Cited

U.S. PATENT DOCUMENTS

| | | | |
|---|---|---|---|
| 2,607,134 | 8/1952 | Langer | 36/67 D |
| 4,357,763 | 11/1982 | Fleischmann et al. | 36/134 X |
| 4,366,632 | 1/1983 | Bente | 36/134 X |
| 4,414,763 | 11/1983 | Bente | 36/134 |
| 4,445,288 | 5/1984 | Fror | 36/134 |
| 4,445,289 | 5/1984 | Benéteau | 36/134 |
| 4,492,047 | 1/1985 | Arff | 36/134 |

FOREIGN PATENT DOCUMENTS

| | | | |
|---|---|---|---|
| 1888123 | 2/1964 | Fed. Rep. of Germany . | |
| 2154951 | 11/1971 | Fed. Rep. of Germany | 36/134 |
| 2542116 | 9/1975 | Fed. Rep. of Germany | 36/67 D |
| 2820381 | 11/1979 | Fed. Rep. of Germany | 36/134 |
| 2098457 | 11/1982 | United Kingdom | 36/134 |

*Primary Examiner*—Werner H. Schroeder
*Assistant Examiner*—T. Graveline
*Attorney, Agent, or Firm*—Sixbey, Friedman & Leedom

[57] ABSTRACT

An athletic shoe sole with cleats having exchangeable gripping elements designed in such a way that the gripping elements can easily be exchanged without incurring diminished stability or premature wear to the shoe sole. To this end, stud-shaped holding elements (2) are provided with a flange (3) with which they are molded into the shoe sole 1. Shoe sole (1) itself, or a portion associated therewith, forms coaxially to the stud-like holding elements (2), a minimum of one raised area (28) which surrounds at least one recess (25) between these raised areas (28) and stud shaped holding elements (2). Finally, the respective recesses (25) are engaged correspondingly shaped projecting elements (26) of the gripping elements or the gripping element components, respectively, which are in the form of caps (9).

20 Claims, 11 Drawing Figures

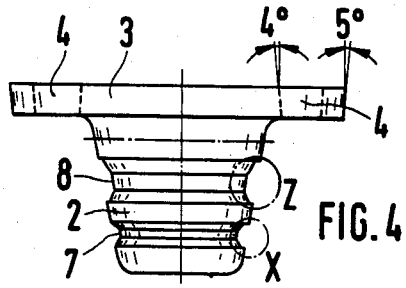
FIG. 4
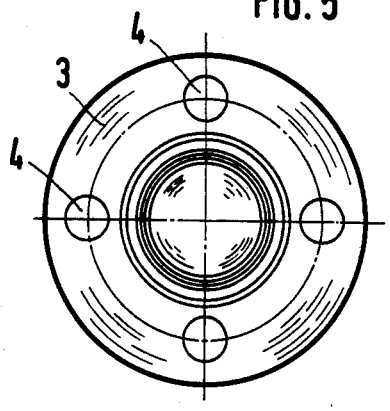
FIG. 5
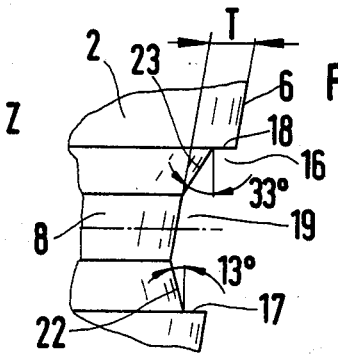
FIG. 4b
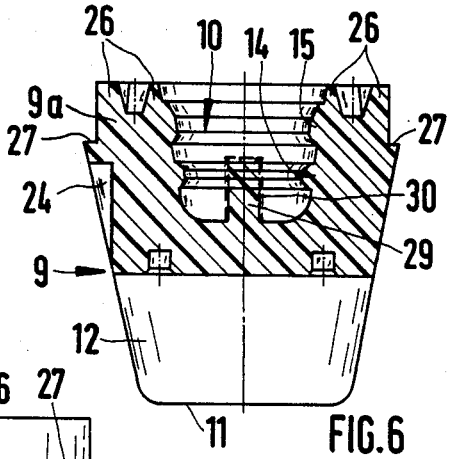
FIG. 6
FIG. 4a
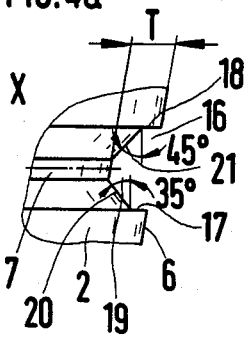
FIG. 8
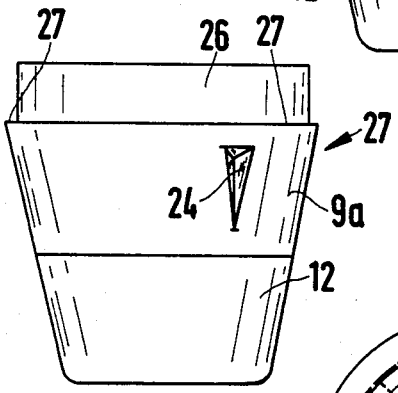
FIG. 7
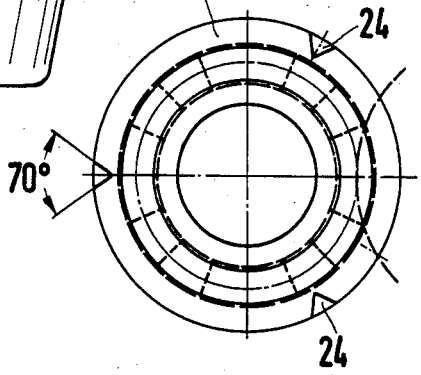
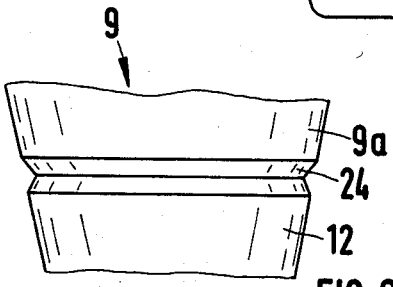
FIG. 9

OUTER SOLE FOR AN ATHLETIC SHOE HAVING CLEATS WITH EXCHANGEABLE GRIPPING ELEMENTS

BACKGROUND AND SUMMARY OF THE INVENTION

The invention relates to a sole for an athletic shoe having cleats with exchangeable gripping elements of the type having stud-shaped holding elements with an outer surface that has at least one snap-lock device by means of which a gripping element of resilient material may be secured on the stud-shaped holding element. Such an athletic shoe is described in German Patent GM 18 88 123 and U.S. Pat. No. 3,054,197.

The shoe described in German GM 18 88 123 provides a stud-shaped fastening element of a cleat, which is usually firmly attached to the sole, e.g., by nailing. A pressure dispersion disk is placed between the cleat and the sole. Additionally, exchangeable caps are slipped onto the cleat and locked into engagement with it in a manner increasing the height of the cleat. Such fastening of the caps is by wedging, for example, by tooth-like projections and associated notches in the outer surface of the cleat, or by a central pin. Additionally, the caps are removable with a suitable tool. This design results in a light-weight, low-cost athletic shoe, wherein the leather cleat is protected and the cleat height can easily be varied.

U.S. Pat. No. 3,054,197 relates to an athletic shoe having a sole into which a riveted fastening member, having an internally threaded bore, is inserted and secured by flanging of the outer edge and simultaneously co-riveting a previously placed pressure dispersion disk. The fastening member, consequently, has to be made of metal. A stud, having a screw shank, is inserted into the interior threaded portion of the holding member. The stud is essentially either of cylindrical shape, having an enlargement at its end, or is of wedge-shaped configuration with an externally increasing radius. This causes the screwed shaft to be weakened in the area of the shoulders, and therefore, presents a greatly increased danger of breakage. The cap forming the actual gripping element is snapped over the stud, whereby the inner wall of the cap is adapted to the outer wall of the stud. Additional disk-like elements which are abrasion resistant can be applied over the cap. Such a cleat assembly has the disadvantage of being costly and the further drawback of the heavy weight of the metal parts, as well as the tendency of the studs to break off easily.

It is the objective of the present invention to provide an athletic shoe sole with exchangeable gripping elements of the foregoing kind, which gripping elements can easily be exchanged in a way that, particularly, prevents a diminished stability of the sole carrying the gripping elements, or damage thereto.

This objective is achieved by the special features of the invention wherein the stud-shaped holding elements have a flange by which they are anchored in the sole with the stud-shaped holding element projecting from the sole at a ground contacting side thereof, wherein the gripping elements are in the form of caps, and wherein the sole is formed with at least one raised area that creates at least one recess coaxially about a respective stud-shaped holding element and into which an open end of a respective gripping element is engaged.

Accordingly, the invention provides for a permanent securing of the gripping elements to the sole. Threading within the sole, and mounting of a special pressure distribution disk are dispensed with. Locally increasing the thickness of the sole not only avoids weakening thereof, but at the same time permits better anchoring of the caps in the recess thus formed and a firmer seating of the caps on the stud-like holding elements.

These and further objects, features and advantages of the present invention will become more obvious from the following description when taken in connection with the accompanying drawings which show, or purposes of illustration only, several embodiments in accordance with the present invention.

BRIEF DESCRIPTION OF THE DRAWINGS

FIG. 4 is a side elevational view of a stud-like holding element formed as an insert member for the sole;

FIGS. 4*a* and 4*b* are, respectively, views of the encircled detail areas of FIG. 4 on an enlarged scale;

FIG. 5 is a bottom plan view of the stud-shaped holding element of FIG. 4;

FIG. 6 is a partial sectional view of the inventive cap;

FIG. 7 is a bottom plan view of the cap according to FIG. 6;

FIG. 8 is a side elevational view of the cap of FIG. 6; and

FIG. 9 is a fragmentary view of a cap having a modified recess for an attachment and/or removal tool.

DETAILED DESCRIPTION OF THE PREFERRED EMBODIMENTS

Figure 1:
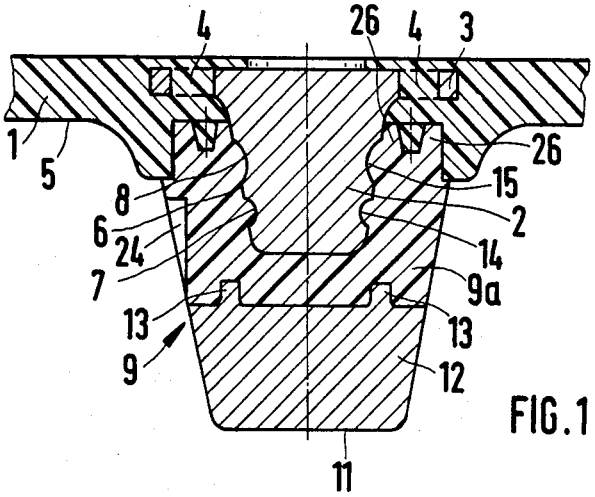
FIG. 1 is a sectional view of a shoe sole having an inserted stud-shaped holding element and a cap mounted thereover.

Numeral 1 designates a shoe sole in FIG. 1, particularly the outsole of a cleated athletic shoe, e.g., football shoe, hockey shoe or baseball shoe. Generally, this outsole is formed of a single piece of injection molded or cast synthetic material, like polyurethane, polyethylene, polyamide, hexamethylenediamine-adipic acid polycondensate or similar material, and extends the entire length of the shoe, including the heel. The heel and sole portions, may however, be two separate parts, in which case, stud-shaped holding elements, described in detail below, and hereinafter referred to as studs, are provided for each part. The studs are distributed in conventional manner. Such distribution, for example, would be determined by considerations of the sole's stress profile and/or required skid resistance of the athletic shoe on the playing field.

Stud 2 has a flange 3 that is firmly molded or cast into outsole 1. So as to ensure good anchoring of flange 3 with the sole material, it is preferably provided with cut-out or undercut configurations 4, for example, in the form of apertures, into which the sole material can flow during molding. Stud 2 projects from outsole 1 at its ground contacting side 5. The preferred shape of the stud is that of a truncated cone, whereby the broader base faces shoe sole 1. The outer surface 6 of stud 2 has a minimum of one, but preferably two spaced apart grooves 7 and 8, which advantageously have the shape of circular annular grooves.

A gripping element in the form of a cap 9, made of elastic material, preferably resilient elastic material, as for instance, polyethylene, polyurethane, polyamide, or such, is snapped onto stud 2. Cap 9 has a recess 10 with a shape that is substantially adapted to the outer contour of stud 2. However, it can be slightly smaller than stud 2, so that cap 9 locks with stud 2 under tension. To enhance the abrasion resistance of cap 9, tread portion 11 of the cap is formed of abrasion resistant material and the side wall areas of base portion 9*a* may be covered with an abrasion resistant material. Tread portion 11, to this end, may consist of a conical disk or dome 12 made of metal, e.g., aluminum, steel, brass, copper, bronze or similar metal or it may consist of leather or a ceramic material like aluminum oxide, steatite, zirconium dioxide, corundum or similar composition. The disk or dome 12 can be glued in place or may have insert and/or snap-lock elements 13, for instance, in the shape of projections or bores, with which it is either inserted or snapped into correspondingly shaped base portion 9*a*, and additionally, may also be glued.

Ribs 14, 15 in recess 10, which preferably should be annular ribs, provide snap-locking engagement of elastic cap 9 or elastic cap member 9*a* with the complementarily shaped annular grooves 7, 8 of stud 2, and which, especially in cross section are adapted in mirror image fashion to the cross section of annular grooves 7, 8.

It has been found that a particularly firm grip and an easy removal of cap 9 is facilitated when longitudinally outer annular groove 7 is narrower than the longitudinally inner annular groove 8, as is clearly illustrated in the drawings. On the other hand, the depth T of annular grooves 7, 8 is equal or nearly equal. The cross section of annular grooves 7, 8, preferably, is rectangular or trapezoidal, nearly trapezoidal or semi-elliptical, relative to the longitudinal axis direction of the stud. Also, a combination of these configurations can be advantageous, as is illustrated by the examples in FIGS. 4*a*, 4*b*. In these views, the grooves 7 and 8 have a radially outer portion 16 that is of rectangular cross sectional shape, so that holding and abutment edges 17, 18 are formed, extending approximately normal to the longitudinal direction of the studs, and a radially inner portion 19 that is of trapezoidal cross-sectional shape. Use of such grooves, aided by semi-elliptical or mirror-image configured annular ribs 14 of recess 10 facilitates easier mounting and removal of the caps.

Advantageously, in a trapezoidal groove cross-sectional arrangement, groove walls 20, 21 of outer narrower annular groove 7 are more inclined than those of walls 22, 23 of annular groove 8, so that annular groove 7 has a greater trapezoidal height than annular groove 8.

Outer groove walls 20, 22 are more inclined in relation to the longitudinal axis of the stud, thus enclosing a smaller angle than inner walls 21, 23. This facilitates, for instance, the ability of caps 9, 9*a* to withstand stress, as well as the ease of their removal. The angle of groove wall 20 is preferably between 30 degrees and 40 degrees, specifically 35 degrees; those of groove wall 21, between 40 degrees and 50 degrees, specifically, 45 degrees; those of groove wall 22, between 10 degrees and 20 degrees, specifically 13 degrees; and those of groove wall 23, between 30 degrees and 40 degrees, specifically 33 degrees.

Stud 2 is made of relatively hard or very hard material, which should, if possible, also be resistant to bending. When using studs that are formed as molded parts of the sole, therefore, at least the outsole portion of shoe sole 1 is made of hard material, for instance, hard PVC, hard polyurethane polyethylene, polyamide, polyimide or polycarbonate. When using a stud 2 which is a separate component that is inserted, snapped-in or molded into sole 1, the studs are made of the synthetic materials mentioned, whereby sole 1, in such a case, may consist of an identical or of a softer material.

Studs 2, as separate components, may also be formed of a metal, like aluminum, copper, brass, bronze, steel, die cast zinc or similar metal, or be made of ceramic materials such as, for instance, aluminum oxide, zirconium dioxide, steatite, silicon carbide, corundum or similar ceramic, or may be made of mixtures of the above combined with other compounds, like $SiO_2$, $CaO_2$, MgO, etc.

Alternatively, in place of disk 12, which is applied to base portion 9*a*, or in addition thereto, cap 9 or base portion 9*a* can be interspersed with a high abrasion material, e.g., glass and/or metal fibers, metal powder or metal oxide powder or particles, either entirely or at least at its tread or grip zone. This is achieved by embedding of the abrasion proof material, or by spraying with a coating of a synthetic substance mixed with one of the above materials.

To facilitate quick attachment and removal of cap 9, or base portion 9*a*, a tool receiving portion 24 is provided in the form of raised and/or recessed areas into which matching formations of a snap-in or snap-off tool can be engaged. In the drawings, these are depicted as prism-like recesses at the outer surface of cap 9 or cap member 9*a*, and in accordance with FIG. 9, tool receiving portion 24 is in the form of an annular groove of triangular cross-section. Other forms of receiving portions 24 can be used, e.g., threaded elements of external hexagonal or other external multi-edged configurations.

Figure 2:
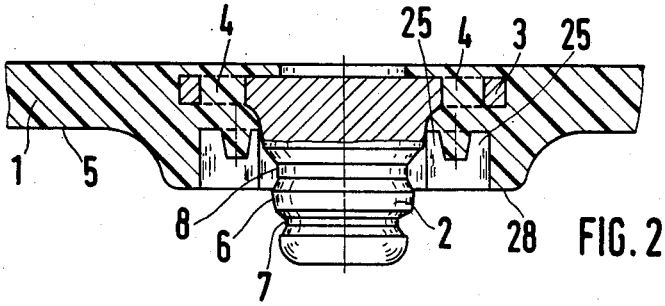
FIG. 2 is a partial section through the shoe sole having a stud-shaped holding element without a cap being slipped over.
Figure 3:
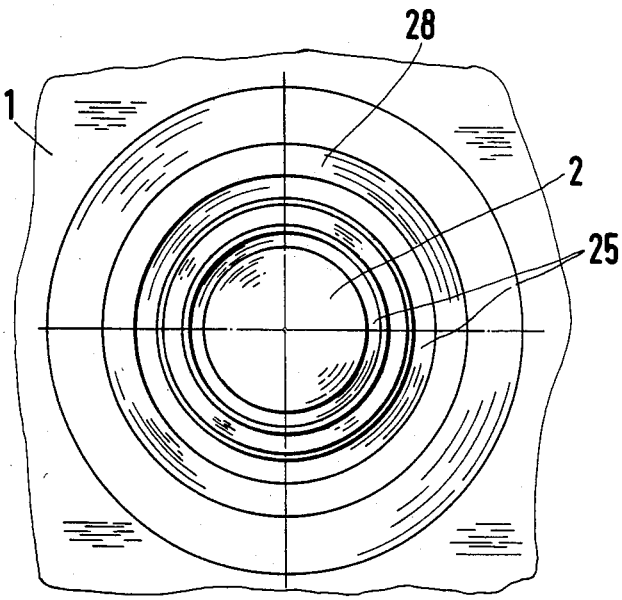
FIG. 3 is a bottom plan view of the shoe sole as illustrated in FIG. 2.

In order to provide the tread portion 11 with an increased stress endurance capability and lateral reinforcement, one or more recesses 25 are provided in shoe sole 1 radially outwardly of stud 2 (FIG. 2). Recesses 25 may, for instance, be in the form of one or several concentric circular or intermittent annular grooves. Preferably, these grooves are formed by a concentration of the material of shoe sole 1, in such a way that there is no reduction of thickness of the sole, for example, by providing one or more concentrically disposed raised areas, such as ring-shaped areas 28, 28*a*.

Cap 9 or cap member 9*a*, respectively have corresponding projections 26 engaging recesses 25, which, for instance, can be in the form of ribs, specifically ribs of circular shape or of intermittent circular shape. Additionally, cap 9 or cap member 9*a* may have an abutment edge 27 which bears on shoe sole 1, or in particular, bears on the rim of the ring-shaped raised area 28 which forms recess 25.

Studs 2 and/or caps 9 or base portions 9*a* and/or disk 12 may be provided of differing lengths in the direction of the stud axis so that the grip of the athletic shoe can be adapted to the conditions of the playing terrain.

Cap 9 or base portion 9*a* may have an inwardly directed stud 29 on the central longitudinal axis which engages a corresponding opening 30 in stud 2 (FIG. 6) for further anchoring of the snap-in arrangement between stud 2 and cap 9, base portion 9*a*.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. An outer sole for an athletic shoe having cleats with exchangeable gripping elements, said cleats being formed of stud-shaped holding elements extending from a broadened base that is anchored within the sole to a free end projecting from the sole at a ground contacting side of the sole, and a gripping element in the form of a cap made of a resilient material for mounting over a projecting portion of a respective one of said holding elements and detachably secured thereto at least one snap-lock arrangement; wherein the holding elements are formed of a single structural part and the broadened base includes a flange about which the sole is molded; wherein the snap-lock arrangement comprises at least one annular snap-lock groove on an outer surface of the projecting portion of each of the stud-shaped holding elements and at least one annular snap-in rib on an inner surface of each cap for engaging a respective snap-lock groove; wherein the sole has a portion disposed about each of the holding elements that is locally thickened to form at least one raised area without producing a reduction in the thickness of other portions of the sole, each raised area creating at least one annular recess coaxially about a respective one of the stud-shaped holding elements; and wherein each cap has a base portion which engages within the annular recess formed by a respective raised area and has a circumferential abutment edge which bears on a rim of the raised area.

2. An outer sole according to claim 1, wherein said flange is provided with perforations which are filled by material of which the sole is formed.

3. An outer sole according to claim 1, wherein the at least one snap-lock groove comprises a pair of annular grooves, one of which is located further from the sole than the other of said annular grooves, and wherein the annular groove that is located further from the sole is narrower than said other of the annular grooves.

4. An outer sole shoe according to claim 3, wherein the stud-shaped holding elements are made of a material from the group consisting of aluminum, brass, steel, bronze, cast zinc, copper, PVC, polyimide, polyurethane, polyethylene, polycarbonate, steatite, aluminum oxide, silicon carbide.

5. An outer sole according to claim 3, wherein an abrasion resistant material is molded at least into tread areas of the caps.

6. An outer sole according to claim 3, wherein an abrasion resistant material, in the nature of leather, ceramic, metal and the like, is applied to gripping surfaces of the caps.

7. An outer sole according to claim 3, wherein said cap has tool receiving portions formed into the periphery thereof.

8. An outer sole according to claim 3, wherein the depth of the annular groove located further from the sole is approximately equal to that of the other of said pair of annular grooves.

9. An outer sole according to claim 8, wherein each of the pair of annular grooves has a cross-sectional shape selected from the group consisting of rectangular, trapezoidal, nearly trapezoidal, semi-elliptical shapes and shapes which are a combination of a trapezoid and a rectangle.

10. An outer sole according to claim 9, wherein said walls of the annular groove located further from the sole are more steeply inclined than those of the other of said pair of annular grooves.

11. An outer sole shoe according to claim 10, wherein the stud-shaped holding elements are made of a material from the group consisting of aluminum, brass, steel, bronze, cast zinc, copper, PVC, polyimide, polyurethane, polyethylene, polycarbonate, steatite, aluminum oxide, silicon carbide.

12. An outer sole according to claim 10, wherein an abrasion resistant material is molded at least into tread areas of the caps.

13. An outer sole according to claim 10, wherein an abrasion resistant material, in the nature of leather, ceramic, metal and like, is applied to gripping surfaces of the caps.

14. An outer sole according to claim 3, wherein each of the pair of annular grooves has a cross-sectional shape selected from the group consisting of rectangular, trapezoidal, nearly trapezoidal, semi-elliptical shapes and shapes which are a combination of a trapezoid and a rectangle.

15. An outer sole according to claim 14, wherein side walls of the annular groove located further from the sole are more steeply inclined than those of the other of said pair of annular grooves.

16. An outer sole shoe according to claim 1, wherein the stud-shaped holding elements are made of a material from the group consisting of aluminum, brass, steel, bronze, cast zinc, copper, PVC, polyimide, polyurethane, polyethylene, polycarbonate, steatite, aluminum oxide, silicon carbide.

17. An outer sole according to claim 1, wherein an abrasion resistant material is molded at least into tread areas of the caps.

18. An outer sole according to claim 1, wherein an abrasion resistant material, in the nature of leather, ceramic metal and like, is applied to gripping surfaces of the caps.

19. An outer sole according to claim 1, wherein said cap has tool receiving portions formed into the periphery thereof.

20. An outersole according to claim 1, wherein each locally thickened portion comprises at least two raised areas, wherein one of the raised areas is disposed radially outwardly of the other of said raised areas with respect to the respective one of said holding elements, wherein the outwardly disposed raised area is of a greater thickness than the other of the raised areas, and wherein the base portion of the cap has projections for engaging in recesses formed between the raised areas and between the respective one of the holding elements and said other of the recessed areas, and wherein the circumferential abutment edge of the cap is an edge in the form of a circular annular flange which engages upon the outwardly disposed raised area.

* * * * *